United States Patent [19]

Karl et al.

[11] 4,142,767

[45] Mar. 6, 1979

[54] SWIVEL ASSEMBLY

[75] Inventors: Robert D. Karl, Pacific Palisades; Ian B. Engh, Northridge; Harry Bennison, Los Angeles, all of Calif.

[73] Assignee: Amtel, Inc., Providence, R.I.

[21] Appl. No.: 852,295

[22] Filed: Nov. 17, 1977

[51] Int. Cl.[2] ..... H01R 39/00

[52] U.S. Cl. ..... 339/1 R; 339/176 T

[58] Field of Search ..... 339/1 R, 6 R, 9 R, 5 R, 339/5 L, 5 M, 5 S, 8 R, 8 L, 176 T, 182 RS

[56] References Cited

U.S. PATENT DOCUMENTS

| | | | |
|---|---|---|---|
| 2,436,949 | 3/1948 | Anderson | 339/8 R |
| 3,538,483 | 11/1970 | Dyer | 339/9 R |

*Primary Examiner*—Roy Lake
*Assistant Examiner*—DeWalden W. Jones
*Attorney, Agent, or Firm*—Freilich, Hornbaker, Wasserman, Rosen & Fernandez

[57] ABSTRACT

A multi-product swivel assembly for carrying oil or other cargo and transmitting electrical power and signal currents, between a ship and stationary oil wells or other installations. The swivel assembly includes a non-rotating or stationary unit, a large upper unit that rotates about the stationary unit, and a center unit that rotates with the upper unit and which extends down within the stationary unit. The center unit includes a large vertical cylinder which surrounds a group of vertical pipes carrying inflammable fluids, and a vertical pipe filled with inert gas and surrounding a conduit that carries an electrical cable. In order to repair the upper rotating unit, as to replace one of the muliple seals thereon, bolts can be loosened to separate it from the center rotating unit. When the bolts are loosened, a shoulder on the stationary unit prevents the center unit from dropping, so that during later reassembly, the bolts will lift up the center unit to its rotating position. To permit access to the bottom of the center rotating unit, jacking bolts are turned to allow the lower portion of the stationary unit to drop down until the seals and the like on the center unit are exposed, the stationary unit being lifted back into place by turning the jacking bolts.

6 Claims, 9 Drawing Figures

FIG. 1
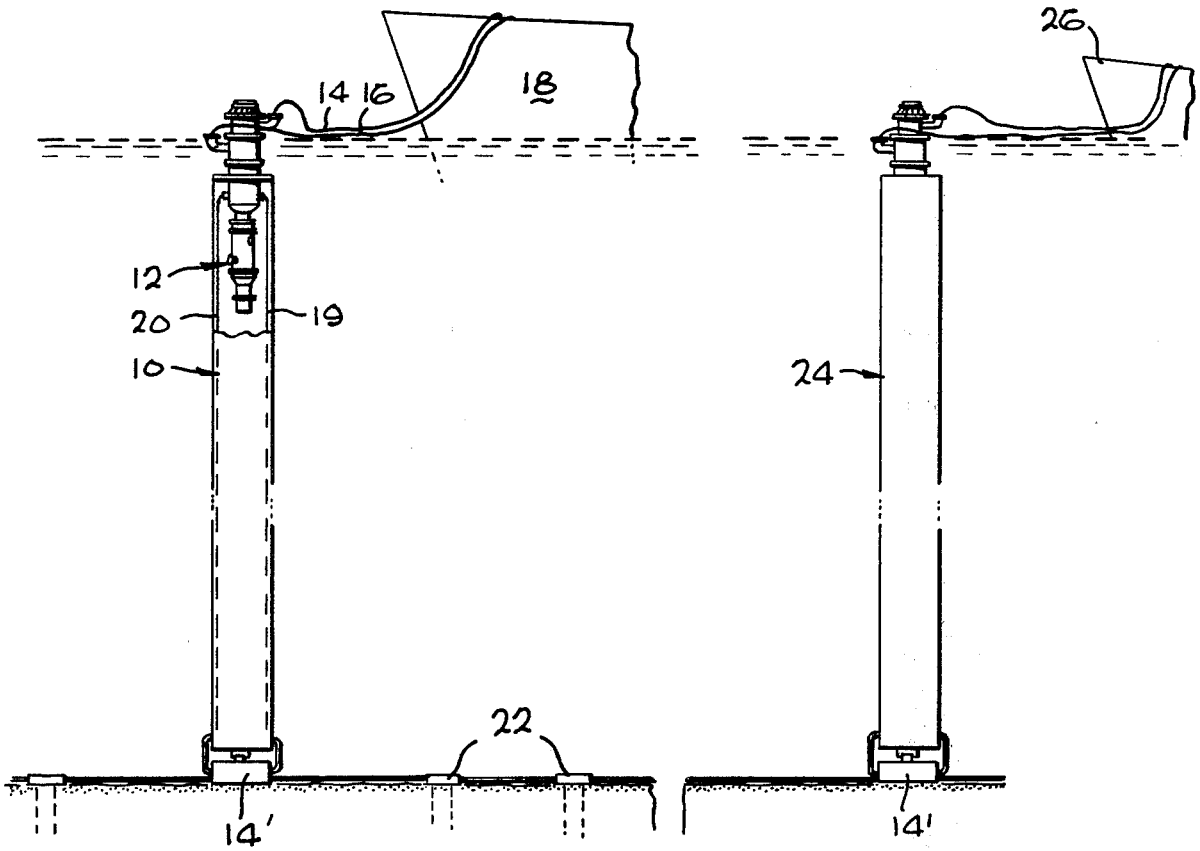
FIG. 4
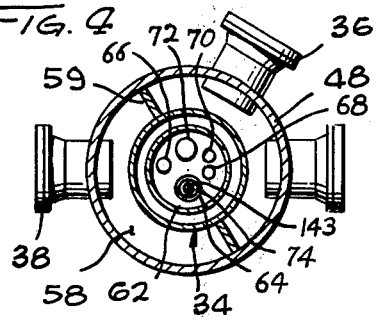
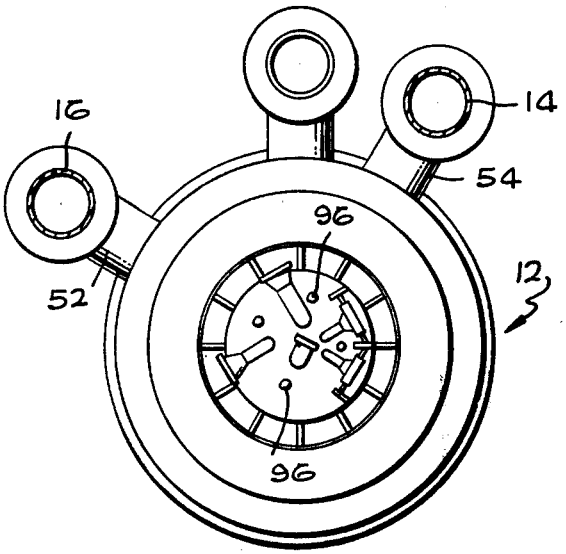
FIG. 3
FIG. 5
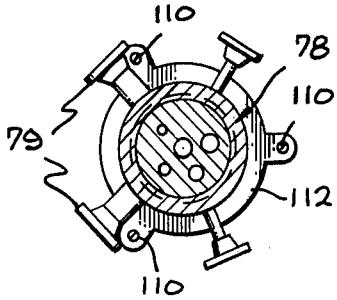

96
96
95
97
98
93
102
32
90
34
30
56
54
92
52
50
50
46
48
59
94
62
100
44
58
60
38
36
30
59

FIG. 7
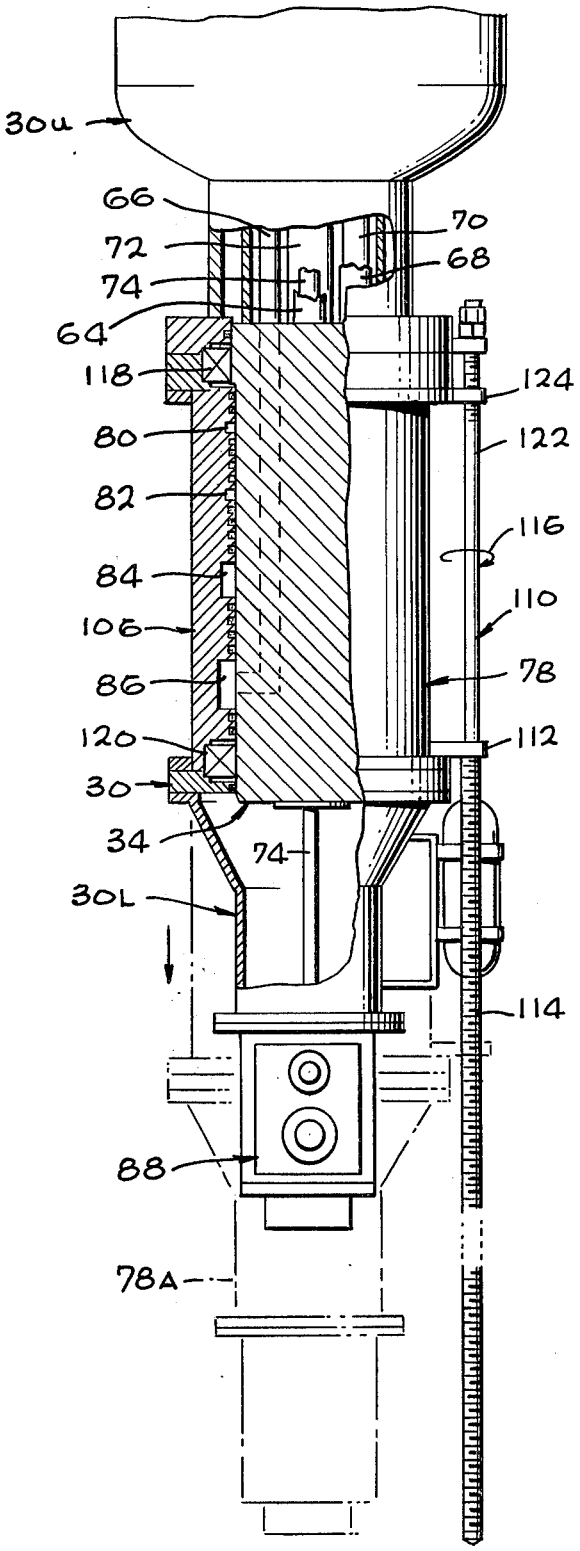
FIG. 9
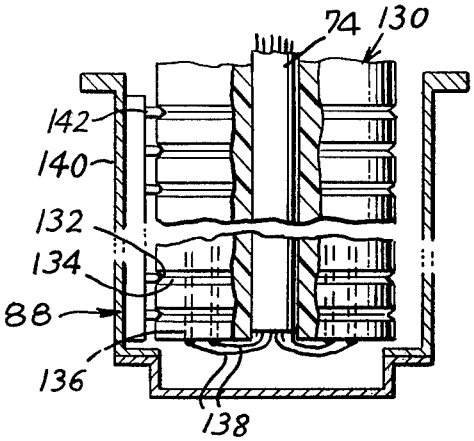
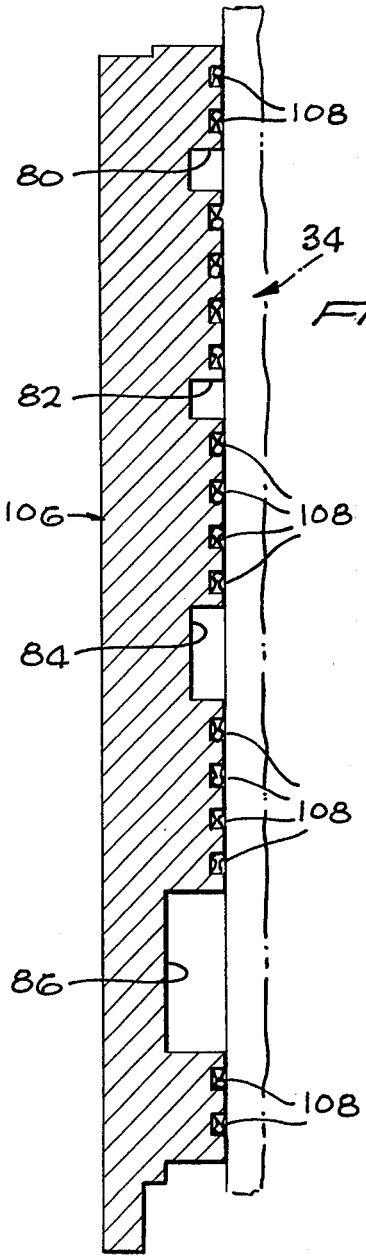
FIG. 8

SWIVEL ASSEMBLY

BACKGROUND OF THE INVENTION

This invention relates to swivel assemblies connecting a stationary installation in a body of water to a ship. One type of installation for transferring multiple products such as crude oil and treated crude oil, includes a long tower whose upper end can connect through hoses to a ship and whose lower end can connect to oil wells and to a controlling well head cellar with pumps and the like at the ocean floor. A swivel assembly at the top of such a tower, may have to transfer multiple cargoes and electrical power and signal currents between a rotary portion that rotates with a ship and a stationary portion that connects to the rest of the tower, and also to connect hydraulic lines, reinjectant gas lines, and the like between rotating and non-rotating portions thereof. Such an assembly requires a large number of seals which may require replacement at intervals. Access to different portions of the swivel assembly, without requiring removal of the entire massive assembly and disassembly thereof, is important in permitting on-site maintenance.

SUMMARY OF THE INVENTION

In accordance with one embodiment of the present invention, a swivel assembly is provided that permits the carrying of flammable fluids and electrical cables, and wherein different sections thereof can be individually detached, easily worked on, and easily replaced, to facilitate maintenance of the assembly. The assembly includes a vertically-extending stationary unit, an upper rotatable unit rotatably mounted about the upper portion of the stationary unit, and a center rotatable unit extending vertically along the length of the stationary unit and having an end connected to the rotatable upper unit to rotate therewith. The center unit includes a vertical cylinder surrounding a group of vertical pipes carrying inflammable fluids, and a vertical pipe filled with inert gas and surrounding a conduit that carries an electrical cable. Work on the upper unit or on the seals lying between the stationary and upper units, is accomplished by unscrewing bolts that hold the upper unit to the center unit, to facilitate lifting up of the upper unit. A shoulder positioned slightly below the normal position of the center unit then supports it so that when detached from the upper unit, the center unit does not fall. The top unit is installed by screwing in the bolts which raise the center unit slightly to attach the two units and also permit the center unit to easily rotate within the stationary unit. Work on the seals between the lower end of the stationary and center units is accomplished by turning a group of jacking bolts to lower the lower portion of the stationary unit so as to enable work to be performed on the seals. Tightening of the jacking bolts raises the previously lowered portion of the stationary unit. The arrangement also facilitates the initial assembly of the prefabricated units.

The novel features of the invention are set worth with particularity in the appended claims. The invention will be best understood from the following description when read in conjunction with the accompanying drawings.

BRIEF DESCRIPTION OF THE DRAWINGS

FIG. 1 is a side view of an installation which contains a swivel assembly constructed in accordance with the present invention.

FIG. 3 is a view taken on the line 3—3 of FIG. 2.

FIG. 4 is a view taken on the line 4—4 of FIG. 2.

FIG. 5 is a view taken on the line 5—5 of FIG. 2.

FIG. 7 is a more detailed sectional side view of the lower portion of the assembly of FIG. 2.

FIG. 8 is a view of a portion of the assembly of FIG. 7.

FIG. 9 is a sectional view of the lower portion of the assembly of FIG. 7.

DESCRIPTION OF THE PREFERRED EMBODIMENT

Figure 2:
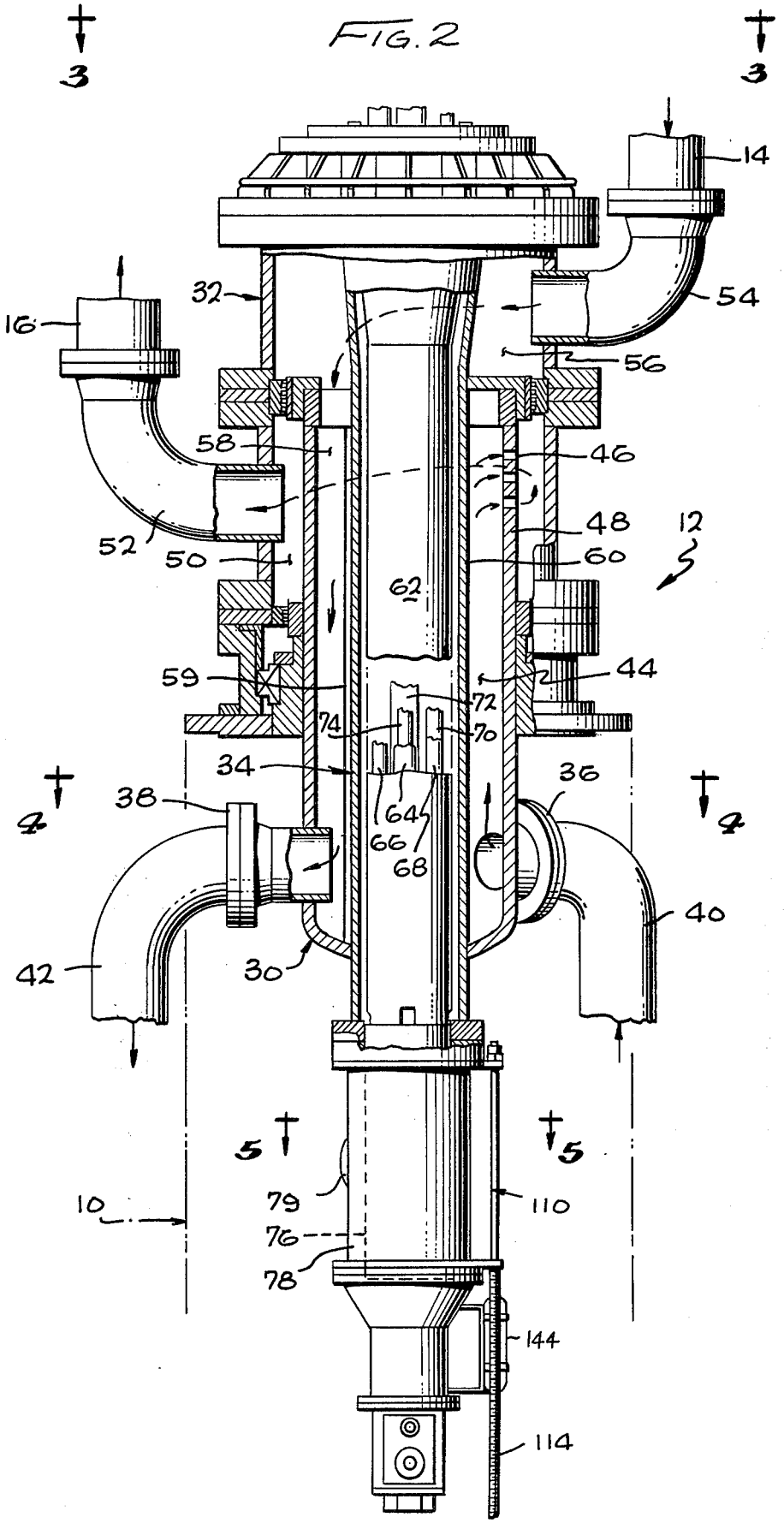
FIG. 2 is a sectional side view of the swivel assembly of FIG. 1.

FIG. 1 illustrates a transfer tower 10 which lies in a large body of water, and which has a swivel assembly 12 at the top and a well head cellar 14 at the bottom. The top of the swivel assembly is connected through hoses 14, 16 to a processing ship 18. Untreated crude oil passes through one of the hoses 14 to the ship 18, where sand, water and other unwanted matter is removed, and treated crude oil is passed back through another hose 16 to the swivel unit. A lower portion of the swivel unit is coupled through a pair of hoses 19, 20 which lead down to the well head cellar 14' where the hoses connect to a group of oil wells 22 that supply untreated crude oil, and to another tower 24 which delivers treated crude oil to ships 26 that carry them to distant locations.

As shown in FIG. 2, the swivel apparatus 12 includes an elongated vertical stationary unit 30 that is substantially fixed with respect to the rest of the tower 10, an upper rotatable unit 32 that rotates about the upper portion of the stationary unit and surrounds it, and an elongated vertical center unit 34 that lies within the stationary unit and which is fixed at its top to the upper unit 32 to rotate with it. The non-rotatable or stationary unit 30, which may pivot to some degree but which does not rotate without limit, includes two couplings 36, 38 that connect to pipes 40, 42 that lead to the bottom of the tower. Coupling 36 receives untreated crude oil for treatment by the vessel 18 (FIG. 1) while coupling 38 delivers treated crude oil for delivery to the other tower 24 that transfers it to a transporting ship. The raw crude oil received by coupling 36 passes into a raw crude oil region 44, up through this region and radially outwardly through holes 46 formed in a casing 48 and through an annular region 50. The raw crude passes from the annular region 50 through a coupling 52 to the hose 16 that leads to the treatment vessel. Treated crude from the vessel passes from the hose 14 into a coupling 54 that leads to an annular treated crude region 56. Treated crude from this region passes down through a chamber 58 (which is separated from region 44 by a wall 59) and out through coupling 38.

The stationary unit 34 includes a long vertical separator pipe 60 that isolates the crude oil from the center unit 34. The center unit 34 includes a vertical cylinder or outer pipe 62 that surrounds five other pipes 64–72. Pipes 68 and 70 are hydraulic lines that carry hydraulic signals from control circuitry in the well head cellar 14 (FIG. 1) at the bottom of the tower to control valves (not shown) at the top of the swivel unit. Pipe 66 is a test line containing oil, to enable the checking of oil pressures. Pipe 72 is a reinjectant gas line through which gas recovered from the crude oil in the treatment vessel, is pumped back into the well to increase oil production. Pipe 64 is an electrical carrier pipe which surrounds an inner pipe or conduit pipe 74 that carries electrical conductors. The space between the two pipes 64 and 74 is filled with nitrogen or other inert gas.

The fluids and cables moving through the lines 66–72 that all rotate with the rest of the center unit, pass through a transfer block 76 which enables transfer of the fluids to a stationary transfer coupler 78 that is connected to several hose couplings or nipples 79. The transfer coupler 78 has several annular recesses that are coupled to the pipes 66–72. As shown in FIG. 7, the two hydraulic lines 68, 70 are coupled to the recesses 80, 82, the gas reinjectant lines 72 is coupled to the recess 84, and the test line 66 is coupled to the recess 86. The cables in the pipes 74 are connected to rings and brushes in an electrical commutater assembly 88 at the bottom of the inner and stationary units 34, 30.

Figure 6:
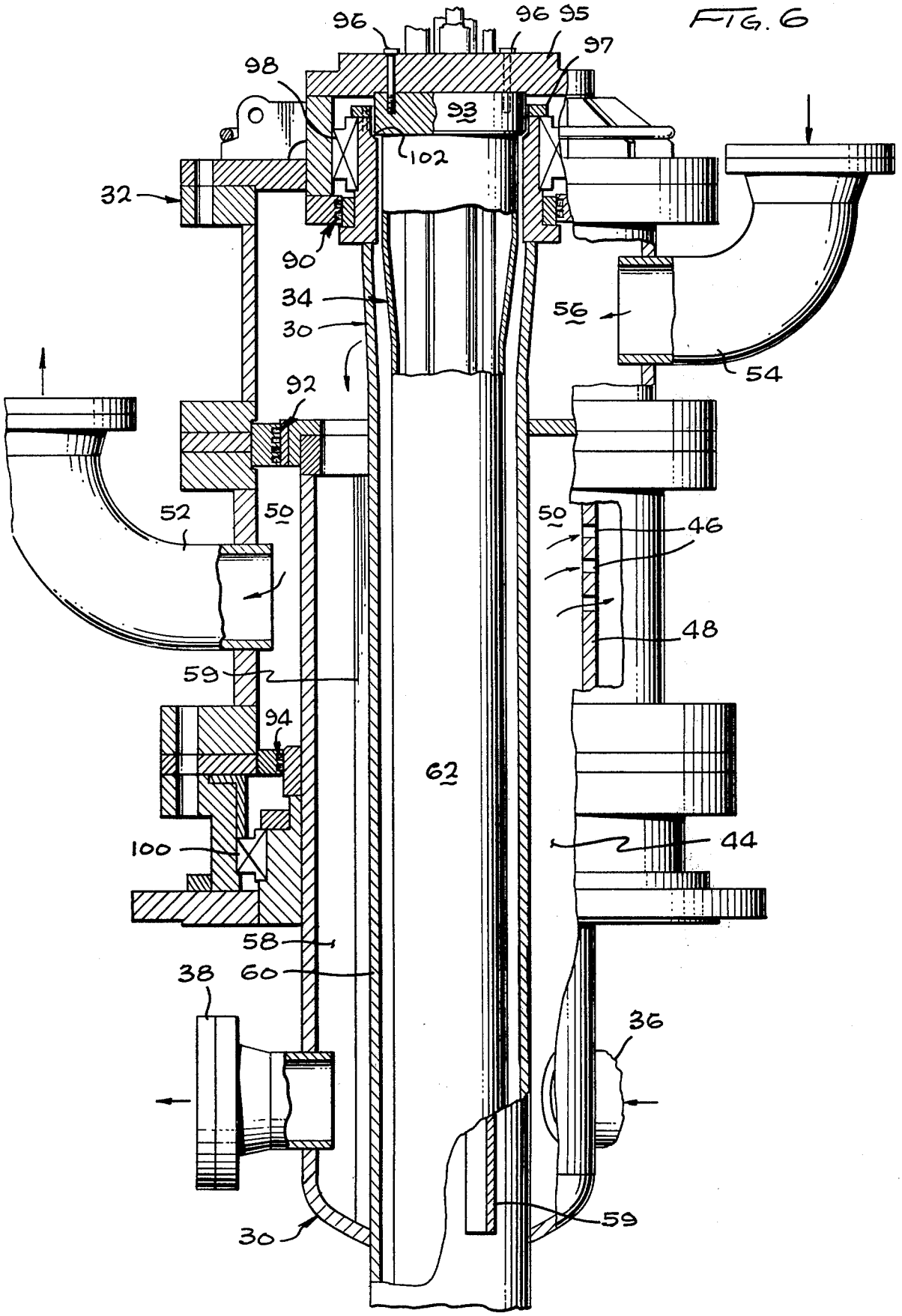
FIG. 6 is a more detailed sectional side view of the upper portion of the assembly of FIG. 2.

The large number of separate fluids to be transferred results in the need for a large number of rotating fluid seals to separate the transfer regions. Such fluid seals may be subject to wearing and damage, and a considerable amount of maintenance is concerned with the replacement of damaged or worn seals. As shown in FIG. 6, there are two groups of seals 90, 92 that isolate the annular treated crude holding region 56 from the environment and another region 50, and there is another group of seals 94 that separate the region 50 from the environment. All of these seals, especially the groups 90, 94 that prevent the spillage of oil into the environment, must be maintained in good working order at all times. The present swivel assembly is constructed to enable access to the seals for their replacement, with minimal disassembly of the swivel assembly. Access to the seal groups 90, 92 and 94 can be obtained by first unscrewing a group of bolts 96 to separate a top plate 95 on the rotatable upper unit 32 from a top manifold plate 93 on the rotatable inner unit 34. A top plate 95, bearing retainer ring 97 and bearing 98 are then removed. The upper unit 32 can then be lifted by a crane to remove the upper unit from the stationary unit 30, to expose the groups of seals 90, 92, 94 so as to permit their replacement.

The rotating units are rotatably mounted on the stationary units with a minimal number of bearings, such as bearings 98, 100 that couple the stationary and top units 30, 32. The upper part of the center unit 34 is rotatably supported by normally fixing the top of the center unit to the upper unit 32 with the bolts 96. The multiple bolts 96 provide a simple connecting device that can be operated by a single workman with a wrench. In order to assure that the center unit will remain in a position that allows easy reassembly, a shoulder 102 is formed on the stationary unit 30 to prevent downward movement of the center unit 34 by more than a fraction of an inch. As the bolts 96 are unscrewed, the center unit 34 is gradually lowered less than an inch until it rests on the shoulder 102 and then does not drop any further. This arrangement prevents possible damage to the center unit which could occur if it suddenly drops, and facilitates reassembly of the unit by allowing it to be raised solely by the bolts 96. In a swivel assembly that has been designed, the center unit is lowered about one centimeter (about three-eighths inch) when it encounters the shoulder. The shoulder is preferable near the top of the center unit, but can be located at any height to engage a corresponding portion of the stationary unit.

FIG. 7 illustrates another region containing numerous seals that may have to be replaced, this being the region where the lower end of the center unit 34 rotates within the stationary unit 30. The stationary, or non-rotatable unit includes an upper part 30U that is surrounded by the upper unit and a lower part 30L that surrounds the lower portion of the center unit. The lower part includes the transfer coupling 78 which comprises a seal block 106 shown in FIG. 8, which carries sixteen rotary seals 108 to seal the different couplings that carry hydraulic fluid, reinjectant gas, and crude oil for pressure monitoring, from one another and from the environment. In order to facilitate access to these seals for replacement, the transfer coupler 78 is held by a group of jacking bolts 110 to the rest of the stationary unit 30 that lies above the transfer coupling. The transfer coupler 78 includes a lower flange 112 that supports the seal block, and that is threadably connected with the threaded lower portion 114 of each jacking screw. As the jacking screw 110 is turned in the direction of arrow 116 (together with the other jacking screws), the flange 112 is gradually lowered along the threaded portion 114 of the jacking screw. Thus, the transfer coupler 78 including the seal block 106, is gradually lowered several feet to the position 78A where it lies below the bottom end of the transfer block 76, so that workmen can gain access to the inside of the transfer coupler 78 to permit the removal and replacement of damaged or worn seals 108. A pair of bearings 118, 120 are provided to rotatably hold the transfer block 76 within the transfer coupler 78, with only the lower bearing 120 moving down with the transfer coupler. The transfer coupler 78 can readily slide down and then up, to lie within these bearings 118, 120, since it is guided in such movement by the upper portions 122 of the jacking screws that slidably engage an upper block flange 124, and that threadably engage the lower flange 112.

As mentioned above, the rotatable center unit includes a pipe 74 that carries electrical cables. FIG. 9 illustrates details of the electrical commutator assembly 88 that connects the rotating cables to stationary cables leading down to the well cellar. The commutator assembly includes a dielectric body 130 of ceramic material having a series of grooves 132 whose groove walls are plated with gold to form slip rings 134. A group of conductors 136 lie within the dielectric body with each conductor extending from each slip ring down to the bottom of the body. The pipe 74 extends through the center of the body, and the cables 138 within the pipe then extend and are connected to the slip ring conductors 136. The stationary unit includes a casing 140 supporting brushes 142 that engage the rotating slip rings, to couple the cables 138 in the rotating unit to another set of cables (not shown) extending to the well head cellar.

As mentioned above, the pipes 66–72 (FIG. 4) within the vertical cylinder 62, carry flammable fluids, including hydraulic fluid, crude oil, and reinjectant gas. The pipe 66 surrounds the conduit 74 which, in turn, surrounds a cable 143 consisting of several electrical conductors insulated from one another. Nitrogen or other inert gas lying between the pipe 66 and conduit 72, is maintained above atmospheric pressure by a pressured tank 144 of such gas which is connected to the inside of pipe 66. This arrangement provides two separate walls between the cable 143 and the fluid carrying pipes 68–72, so that any sparks from short-circuited wires in the cable must pass through two walls to reach a fluid carrying pipe.

Thus, the invention provides a multi-product swivel assembly which safely carries both flammable fluids and electric currents, and which facilitates the partial disassembly and reassembly thereof to enable the replacement of rotary seals and electrical components. The current-carrying cable lies in a conduit which lies in an inert gas-filled pipe lying adjacent to other pipes that carry flammable fluids. Access to the upper portion of the swivel assembly can be gained by merely unscrewing a group of bolts, to gradually lower an inner rotary unit until it rests on a supporting shoulder, and to separate the inner rotary unit from an upper rotary unit so it can be lifted off for access to the seals thereat. Access to a group of seals at the lower end of the swivel assembly is gained by the use of jacking screws which can be turned to lower a transfer coupler from around a transfer block, to permit access to the seals that normally lie between them.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A swivel assembly for lying in a body of water to transfer oil, natural gas, or other cargo to or from a ship or other floating structure comprising:

a non-rotatable unit;

an upper unit surrounding the upper portion of said non-rotatable unit;

a center unit having a portion lying within said non-rotatable unit;

said upper unit having a top plate lying over said center unit, and said center unit having a top plate normally lying immediately under said upper unit top plate, said top plates having aligned holes;

a plurality of bolts extending through holes of said upper unit top plate and threadably engaged with holes of said center unit top plate; and said non-rotatable unit having walls defining a shoulder for supporting said center unit against falling when disconnected from said upper unit, whereby unscrewing said bolts can gently lower the center unit onto the shoulder, while screwing in the bolts can raise the center unit off the shoulder.

2. The assembly described in claim 1 wherein:

said shoulder is positioned at a height to support said center unit when it is lowered less than an inch from its fully raised position at which said bolts are fully tightened, whereby to provide enough clearance over the shoulder to avoid interference with normal rotation of the center unit, but permit the bolts to raise and lower the center unit with minimal turning of the bolts.

3. A swivel assembly for lying in a body of water, to transfer oil, natural gas, or other cargo to or from a ship or other floating structure, comprising:

a non-rotatable unit having upper and lower parts;

a rotatable center unit having a lower portion lying within said non-rotatable unit, said center unit including a plurality of pipes extending largely vertically therein;

said lower part of said non-rotatable unit having a plurality of hose couplings, and a transfer coupler for transferring fluid between said pipes and said hose couplings;

a plurality of fluid seals vertically spaced from one another and disposed between said lower part of said center unit and said transfer coupling of said non-rotatable unit; and a plurality of jacking screws rotatably mounted on said upper part of said non-rotatable unit and threadably engaged with the lower part of said non-rotatable unit, to permit the controlled lowering of said lower part to enable access to the seals.

4. The swivel assembly described in claim 3 including:

a plurality of cables extending along one of said pipes of said center unit, said pipe carrying said cables extending down through said transfer coupler;

an electrical commutator assembly lying below said transfer coupling, including a body connected to said rotatable unit having a plurality of slip rings connected to said cables, and a plurality of brushes engaged with said slip rings and mounted on the lower part of said non-rotatable unit to move down therewith when the jacking screws are turned to lower them, to provide access to the brushes and to the slip rings and their cable connections.

5. A swivel assembly for lying in a body of water, to transfer oil, natural gas, or other cargo to or from a ship or other floating structure, comprising:

a stationary unit having upper and lower portions;

a rotatable upper unit surrounding the upper portion of the stationary unit and rotatable thereon;

a rotatable center unit connected to the upper unit to rotate therewith, and extending vertically between the upper and lower portions of the stationary unit;

a plurality of pipes extending vertically along the center of the center unit;

a plurality of electrical conductors, said conductors extending along at least one of said pipes;

a transfer coupler lying at the lower portion of said stationary and center units, including a transfer block rotating with said center unit and a seal block closely surrounding said transfer block and having a plurality of axially spaced seals, at least one of said pipes that carries cables extending down through said transfer block; and an electrical commutator assembly located below said transfer coupler and including a body rotatable with said center unit and carrying a plurality of vertically spaced slip rings coupled to said cables, and a casing mounted on said stationary unit and carrying a plurality of brushes engaged with said slip rings.

6. A swivel assembly for lying in a body of water, to transfer oil, natural gas, or other cargo to or from a ship or other floating structure, and to carry electrical power and signals therebetween, comprising:

a stationary unit having upper and lower portions;

a rotatable upper unit surrounding the upper portion of the stationary unit and rotatable thereon; and a rotatable center unit connected to the upper unit to rotate therewith, and extending vertically between the upper and lower portions of the stationary unit;

said center unit including a vertical cylinder, a plurality of vertical fluid-carrying pipes lying within said cylinder for carrying flammable fluids, a vertical cable-carrying pipe lying within said cylinder, a conduit pipe lying within said cable-carrying pipe, and at least one cable lying in said conduit pipe.

* * * * *